US011565371B2

(12) United States Patent
Hacker

(10) Patent No.: US 11,565,371 B2
(45) Date of Patent: Jan. 31, 2023

(54) SYSTEMS AND METHODS FOR FORMING SEMICONDUCTOR CUTTING/TRIMMING BLADES

(71) Applicant: Micron Technology, Inc., Boise, ID (US)

(72) Inventor: Jonathan S. Hacker, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 794 days.

(21) Appl. No.: 16/237,051

(22) Filed: Dec. 31, 2018

(65) Prior Publication Data

US 2020/0206869 A1 Jul. 2, 2020

(51) Int. Cl.
*B24B 53/04* (2012.01)
*B24B 53/065* (2006.01)
(Continued)

(52) U.S. Cl.
CPC ..... *B24B 53/017* (2013.01); *B24B 3/36* (2013.01); *B24B 3/46* (2013.01); *B24B 37/02* (2013.01);
(Continued)

(58) Field of Classification Search
CPC .. B24B 3/36; B24B 3/46; B24B 3/463; B24B 37/02; B24B 53/00; B24B 53/017; B24B 53/04; B24B 53/047; B24B 53/06; B24B 53/065; B24B 53/07; B24B 53/12; B24D 15/04; B24D 15/06; B24D 15/065
(Continued)

(56) References Cited

U.S. PATENT DOCUMENTS 4,339,896 A 7/1982 Dennis et al.
5,836,229 A * 11/1998 Wakayama ..... C03B 33/12 83/886
(Continued)

FOREIGN PATENT DOCUMENTS

CN 201253809 Y 6/2009
CN 202212869 U 5/2012
(Continued)

OTHER PUBLICATIONS

CN Patent Application No. 201911219199.6—Chinese Office Action and Search Report, dated Jun. 29, 2021, with English Translation, 19 pages.
(Continued)

*Primary Examiner* — Eileen P Morgan
(74) *Attorney, Agent, or Firm* — Perkins Coie LLP

(57) ABSTRACT

A dressing board for sharpening and/or shaping blades for manufacture of semiconductor devices can include a working surface configured to sharpen and/or shape a cutting surface of a dicing or edging blade for manufacture of a semiconductor device. The working surface can be configured to contact the cutting surface of the blade when sharpening or shaping the cutting surface. The dressing board can include a support substrate configured to support the working surface with respect to a floor of an enclosure in which the dressing board is positioned. In some embodiments, the working surface includes a first portion that is not parallel to the floor.

9 Claims, 7 Drawing Sheets

(51) Int. Cl.

| | |
|---|---|
| ***B24B 3/36*** | (2006.01) |
| ***B24B 3/46*** | (2006.01) |
| ***B24B 53/07*** | (2006.01) |
| ***B24D 15/06*** | (2006.01) |
| ***B24B 53/017*** | (2012.01) |
| ***B24B 37/02*** | (2012.01) |
| ***B24B 53/12*** | (2006.01) |

(52) U.S. Cl.
CPC ..... *B24B 53/04* (2013.01); *B24B 53/065* (2013.01); *B24B 53/07* (2013.01); *B24B 53/12* (2013.01); *B24D 15/06* (2013.01)

(58) Field of Classification Search
USPC ..... 451/56, 443, 458
See application file for complete search history.

(56) References Cited

U.S. PATENT DOCUMENTS

| | | | | |
|---|---|---|---|---|
| 6,176,762 | B1 * | 1/2001 | Shimizu | B24B 1/00 125/11.01 |
| 10,022,838 | B2 * | 7/2018 | Akita | B24B 53/062 |
| 10,576,608 | B2 * | 3/2020 | Sekiya | B24B 53/14 |
| 10,668,595 | B2 * | 6/2020 | Sekiya | B24B 53/12 |
| 10,898,983 | B2 * | 1/2021 | Komatsu | B24B 3/36 |
| 2019/0061093 | A1 * | 2/2019 | Sekiya | B24B 27/0683 |
| 2019/0314953 | A1 * | 10/2019 | Nakamura | B23K 26/53 |
| 2020/0206869 | A1 * | 7/2020 | Hacker | B24B 53/12 |

FOREIGN PATENT DOCUMENTS

| | | | |
|---|---|---|---|
| CN | 203092377 | U | 7/2013 |
| CN | 204171804 | U | 2/2015 |
| CN | 105215795 | A | 1/2016 |
| CN | 205166554 | U | 4/2016 |
| CN | 107617978 | A | 1/2018 |
| EP | 3305468 | A1 | 4/2018 |
| JP | 5460147 | B2 | 4/2014 |

OTHER PUBLICATIONS

CN Patent Application No. 201911219199.6—Chinese Office Action and Search Report, dated Mar. 10, 2022, with English Translation, 17 pages.

CN Patent Application No. 201911219199.6—Chinese Office Action and Search Report, dated Sep. 7, 2022, with English Translation, 12 pages.

* cited by examiner

SYSTEMS AND METHODS FOR FORMING SEMICONDUCTOR CUTTING/TRIMMING BLADES

TECHNICAL FIELD

The present technology generally relates to semiconductor devices, and in some embodiments more particularly to methods and systems for forming and/or repairing semiconductor cutting and trimming tools.

BACKGROUND

Microelectronic devices, such as memory devices, microprocessors, and light emitting diodes, typically include one or more semiconductor die mounted to a substrate (e.g., a wafer, silicon wafer, or other substrate). Semiconductor die can include functional features, such as memory cells, processor circuits, and interconnecting circuitry. Semiconductor die also typically include bond pads and pillar structures electrically coupled to the functional features. The bond pads can be electrically coupled to pins or other types of terminals for connecting the semiconductor die to busses, circuits, or other assemblies.

One step in the process of manufacturing certain microelectronic devices is the dicing or singulation stage. In this step, a substrate having more than one device mounted thereon is cut or otherwise partitioned to separate the devices from each other. The cutting may be performed by a blade, saw, laser, chemical(s), and/or other means of segregating the substrate into multiple pieces. In some applications, trimming or shaping of the substrate or other portion of the microelectronic devices may be desirable. For example, chamfered or radiused edges may be desired.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology.

DETAILED DESCRIPTION

Specific details of several embodiments of dressing boards and associated systems and methods, are described below. The term "semiconductor device," as used herein, generally refers to a solid-state device that includes one or more semiconductor materials. Examples of semiconductor devices include logic devices, memory devices, microprocessors, and diodes among others. Furthermore, the term "semiconductor device" can refer to a finished device or to an assembly or other structure at various stages of processing before becoming a finished device. Depending upon the context in which it is used, the term "substrate" can refer to a wafer-level substrate or to a singulated, die-level substrate. A person having ordinary skill in the relevant art will recognize that suitable steps of the methods described herein can be performed at the wafer level or at the die level. Furthermore, unless the context indicates otherwise, structures disclosed herein can be formed using conventional semiconductor-manufacturing techniques.

For ease of reference, identical reference numbers are used to identify similar or analogous components or features throughout this disclosure, but the use of the same reference number does not imply that the features should be construed to be identical. Indeed, in many examples described herein, identically numbered features have a plurality of embodiments that are distinct in structure and/or function from each other. Furthermore, the same shading may be used to indicate materials in cross section that can be compositionally similar, but the use of the same shading does not imply that the materials should be construed to be identical unless specifically noted herein.

FIG. 1 illustrates an embodiment of a cutting or grind blade 10. The blade 10 includes a cutting surface 12 configured to cut, trim, shape, or otherwise modify a shape of a substrate or other portion of a semiconductor device. The cutting surface 12 is configured to rotate about an axis of rotation 14. Preferably, the axis of rotation 14 of the blade 10 is positioned at a geometric center of the blade 10 when observed parallel to the axis of rotation 14. The blade 10 includes a blade body 16 extending between the axis of rotation 14 and the cutting surface 12. In some embodiments, the blade body 16 is solid (e.g., without cavity, aperture, hole, or other material absence) between the axis of rotation 14 and the cutting surface 12.

Figure 1B:
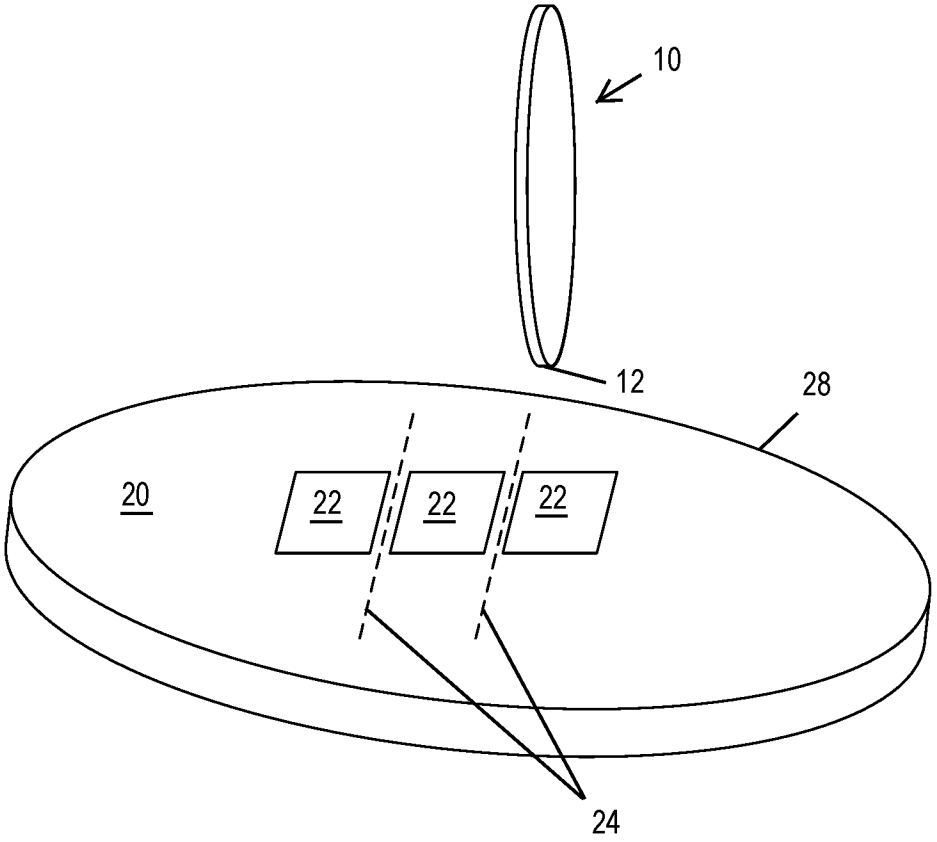
FIG. 1B is a perspective view of a cutting or trimming blade and a substrate to be diced.
Figure 1A:
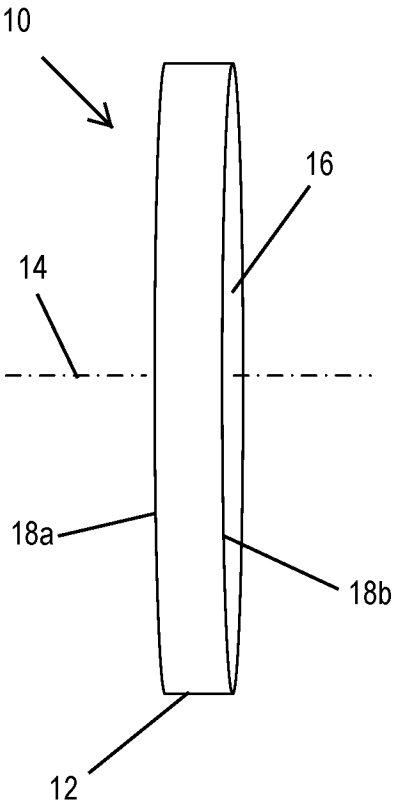
FIG. 1A is a perspective view of a cutting or trimming blade.

In the embodiment illustrated in FIG. 1A, the cutting surface 12 of the blade 10 is flat (e.g., parallel to the axis of rotation 14). In some embodiments, the cutting surface 12 is flat from a first lateral edge 18*a* to a second lateral edge 18*b* of the cutting surface 12. In some embodiments, all or a portion of the cutting surface 12 of the blade 10 is curved as observed perpendicular to the axis of rotation 14. The blade 10 cutting surface 12 can include one or more curved portions as observed perpendicular to the axis of rotation 14 of the blade 10.

The shape of the cutting surface 12 is often dictated by the desired shape of the finished semiconductor device. For example, for beveled edges, it may be desirable to use a blade 10 having a cutting surface 12 that is sloped with respect to the axis of rotation 14. For radiused edges, it may be desirable to use a blade 10 having a cutting surface 12 that is concave when observed parallel to the axis of rotation 14. For dicing/singulation processes, a blade 10 having a sharp cutting surface 12 may be desirable.

As illustrated in FIG. 1B, the blade 10 can be positioned adjacent a substrate 20 during a dicing/singulation process. The substrate 20 can have one or more semiconductor devices 22 mounted thereon. In some embodiments, one or more dicing streets/lanes 24 are formed on a surface of the substrate 20. The dicing streets 24 can guide the blade 10 as the cutting surface 12 dices the substrate 20 to separate the semiconductor devices 22. The dicing streets 24 can be formed by etching the substrate 20. Suitable etchants include, but are not limited to, nitric acid or hydrofluoric acid. The etchants can be used to form the dicing streets 24 in a photolithographic mask process or another process. The width of and separation between the dicing streets 24 can be selected to produce semiconductor devices 22 of desired shapes and sizes. In some embodiments, the dicing process is performed without the formation of dicing streets or lanes.

The blade 10 can be directed into contact with the substrate 20 along the dicing streets 24 and/or along a predetermined path. The blade 10 can be used to cut the substrate 20 to separate the semiconductor devices 22 from each other in a desired pattern. In some embodiment, edges of the semiconductor devices 22 and/or edges 28 of the substrate 20 may be trimmed or shaped by a blade 10 (e.g., either the same blade or a different blade from the blade used to dice the substrate 20). In some applications, other features may be formed by the cutting blade 10. For example, the blade 10 may be used to form structures such as pyramids, domes, columns, and/or other structures on or in the substrate or other portion of the semiconductor device.

Figure 2B:
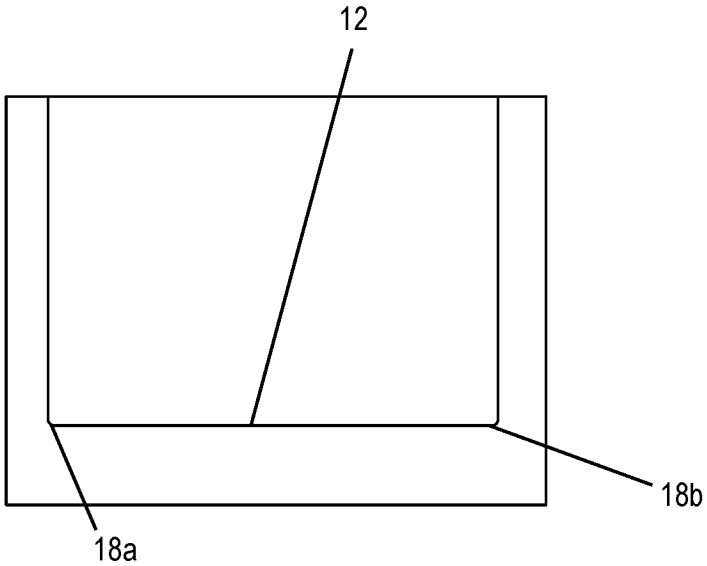
FIG. 2B is a cross-sectional view of a new or refurbished edge of a cutting blade.
Figure 2A:
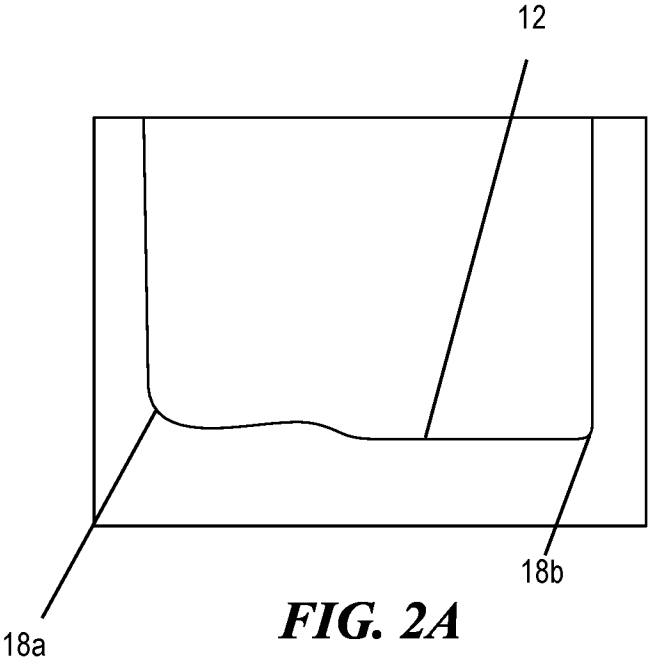
FIG. 2A is a cross-sectional view of a worn edge of a cutting blade.

Use of the blades 10 to dice/trim/form semiconductor devices 22 and substrates 20 wears down cutting surfaces 12, edges 18*a*, 18*b*, and/or other portions of the blades 10. As illustrated in FIG. 2A, the cutting surface 12 may wear in an uneven or otherwise undesirable manner. For example, the first lateral edge 18*a* of the cutting surface 12 may chip or otherwise erode after a finite number of uses. In some cases, damage to the cutting surface 12 occurs at locations between the lateral edges 18*a*, 18*b*. Repair or refurbishment of flat blade cutting surfaces 12 may be accomplished using flat dressing boards. Such dressing boards are able to restore a flat cutting surface 12, as illustrated in FIG. 2B.

Figure 3C:
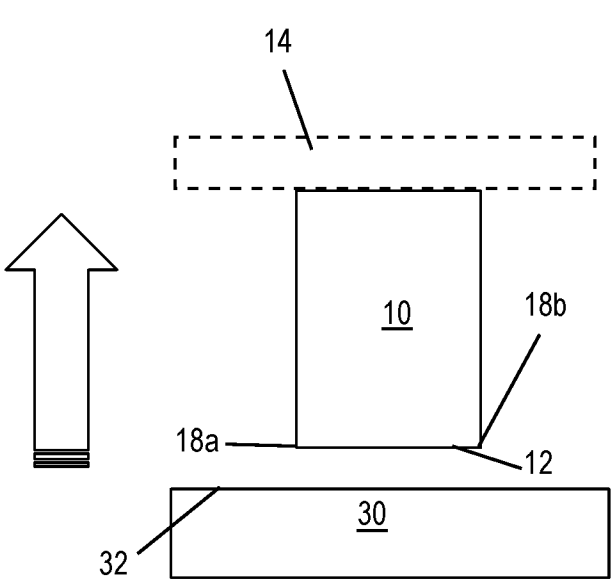
FIG. 3C is a cross-sectional view of the cutting blade of FIG. 3A after repair by the dressing board.
Figure 3B:
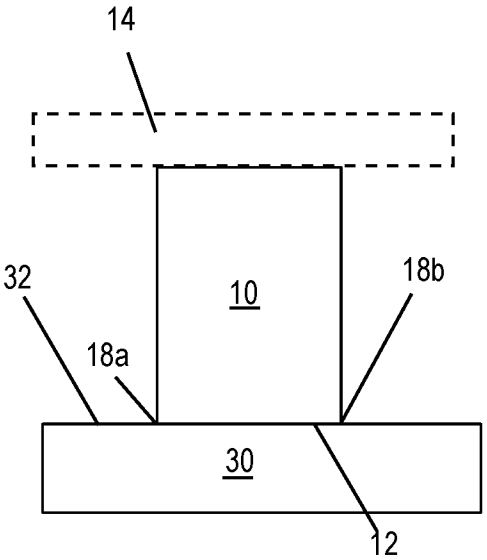
FIG. 3B is a cross-sectional view of the cutting blade of FIG. 3A in contact with the dressing board of FIG. 3A.
Figure 3A:
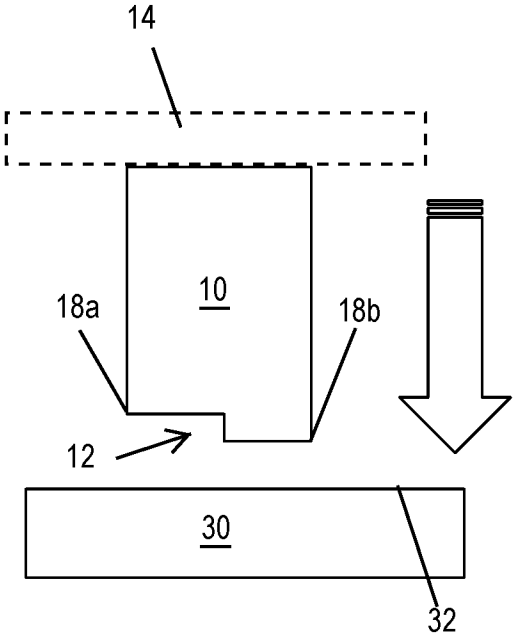
FIG. 3A is cross-sectional view of a worn cutting blade and a dressing board.

Another example of repairing a flat cutting surface 12 of a blade 10 using a flat dressing board 30 is illustrated in FIGS. 3A-3C. In such a process, the cutting surface 12 of the blade 10 is brought into contact with the working surface 32 (e.g., grinding surface) of the dressing board 30 while the blade 10 is rotated about its axis of rotation 14. The blade 10 is pressed toward the dressing board 30, wherein the rotation of the blade 10 combined with the force of the blade 10 toward the dressing board 30 allows the working surface 32 to repair/reshape the cutting surface 12. The working surface 32 of the dressing board 30 can be constructed from various forms of silicon carbide, quartz, synthetic moissanite, carbon fiber reinforced carbon, and/or other appropriate materials or combinations of materials. In the illustrated example, the axis of rotation 14 of the blade is parallel to the working surface 32 of the dressing board 30. In such an example, the resulting repaired/refurbished cutting surface 12 is parallel to the axis of rotation of the blade 10.

Figure 4C:
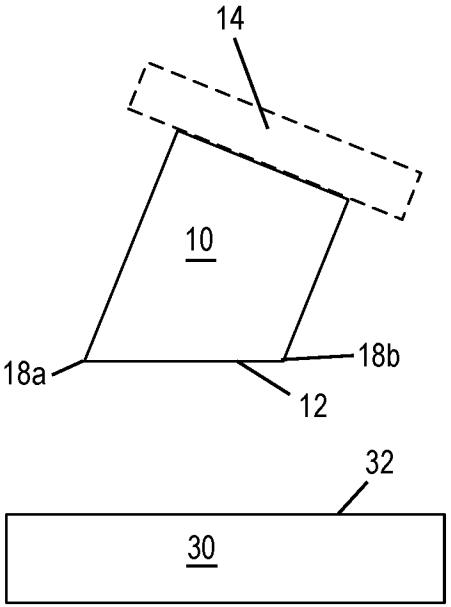
FIG. 4C is a cross-sectional view of the cutting blade of FIG. 4A after repair by the dressing board.
Figure 4B:
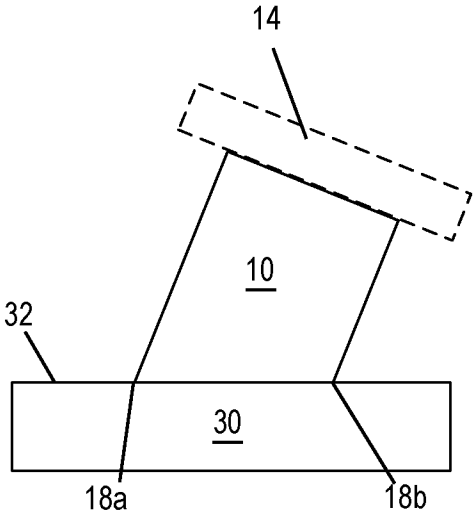
FIG. 4B is a cross-sectional view of the cutting blade of FIG. 4A in contact with the dressing board of FIG. 4A.
Figure 4A:
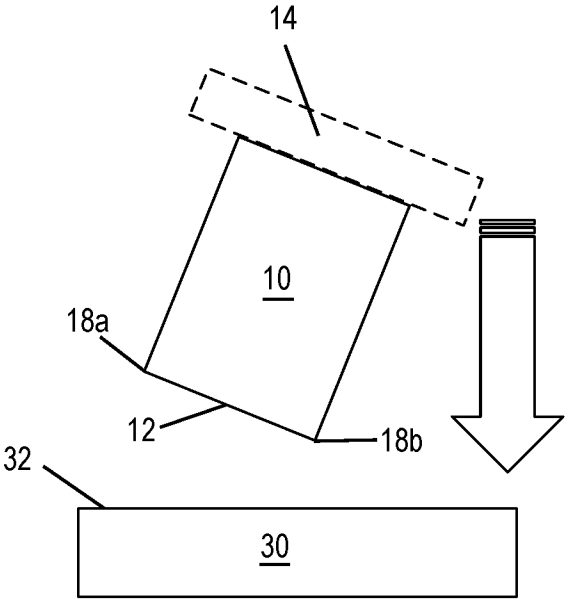
FIG. 4A is cross-sectional view of a worn cutting blade and a dressing board, wherein the axis of rotation of the cutting blade is non-parallel to the surface of the dressing board.

In some applications, as illustrated in FIGS. 4A-4C, flat dressing boards 30 can be used to form or repair sloped cutting surfaces 12. To accomplish this, the axis of rotation 14 of the blade 10 can be oriented at a non-zero angle with respect to the flat working surface 32 of the dressing board 30. The resulting angle of the cutting surface 12 after repair/refurbishment with respect to the axis of rotation 14 of the blade 10 will then be equal or substantially equal to the angle between the axis of rotation 14 of the blade 10 with respect to the working surface 32. Such an arrangement, where the axis of rotation 14 is non-parallel to the flat working surface 32 of the dressing board 30 can require that either the mechanism for moving the blade 10 toward the dressing board 30 moves in a direction non-perpendicular to the flat working surface 32, or the mechanism for moving the blade 10 toward the dressing board 30 moves in a direction non-perpendicular to the axis of rotation 14 of the blade 10. In either instance, precise alignment of the angle of the cutting surface 12 can be difficult to attain, as the angle between the mechanism movement path, the axis of rotation 14, and the flat working surface 32 should each be precisely controlled. Precise control can be required to ensure cutting surface shape precision within 100 microns. Accordingly, it is desirable that a dressing board 30 be capable of accommodating and repairing/refurbishing blades 10 having cutting surface 12 that are not entirely flat and parallel to the axis of rotation 14 of the blade 10. Preferably, the repairing/refurbishing would be possible using a process wherein the cutting surface 12 can be repaired/refurbished in a single position relative to the dressing board 30 and/or the axis of rotation 14 of the blade 10 can be oriented parallel to horizontal during the repair/refurbishment process. As used herein, "horizontal" can be parallel to the floor of the room in which the dressing board is used, the slope of the table or other structure on which the dressing board is positioned, and/or perpendicular to the direction of the force of Earth's gravity. The dressing boards described herein can include support substrates (e.g., tables, stands, pedestals, etc.) configured to support the dressing board in a working area.

Figures 5A, 5B, 5C:
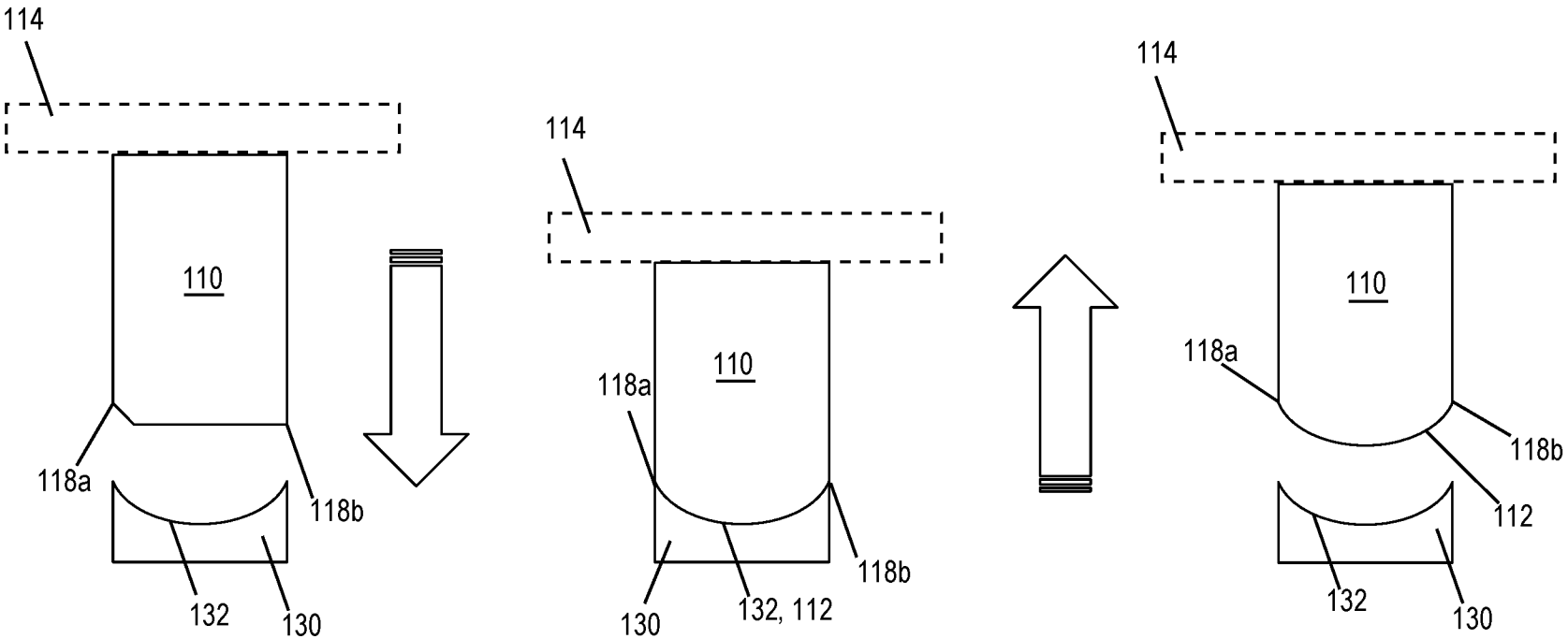
FIG. 5A is cross-sectional view of a worn cutting blade and a non-planar dressing board.
FIG. 5B is a cross-sectional view of the cutting blade of FIG. 5A in contact with the dressing board of FIG. 5A.
FIG. 5C is a cross-sectional view of the cutting blade of FIG. 5A after repair by the dressing board.

FIGS. 5A-5C illustrate an embodiment of a dressing board 130 suitable for repairing, forming, and/or refurbishing blades 110 having non-flat cutting surfaces 112 as observed perpendicular to the axis of rotation 114 of the blades 110. In the illustrated example, a blade 110 having a flat or substantially flat cutting surface 112 can be brought into contact with the dressing board 130. In some embodiments, the cutting surface 112 has a profile that generally matches the shape of the working surface 132 of dressing board 130, with damaged or worn portions. Rotation of the blade 110 about the axis of rotation 114 while applying force on the blade 110 toward dressing board 130 can facilitate reshaping/repairing of the blade cutting surface 112 such that the profile of the blade cutting surface 112 matches or substantially matches the profile of the working surface 132 of the dressing board 130. In the illustrated example, the working surface 132 has a concave curved shape, resulting in a blade 110 having a cutting surface 112 that is convex and curved.

FIGS. 6A-6D illustrate additional embodiments of dressing boards having shaped, working surfaces. For example, the dressing board 230 illustrated in FIG. 6A has a working surface 232 that is oriented at an angle A1 with respect to horizontal. The angle A1 can be any value between 0° and 90°. In some embodiments, a portion of the working surface 232 dressing board 230 is oriented at a second angle different from the first angle A1, resulting in a working surface having two or more slopes with respect to horizontal.

Figure 6A:
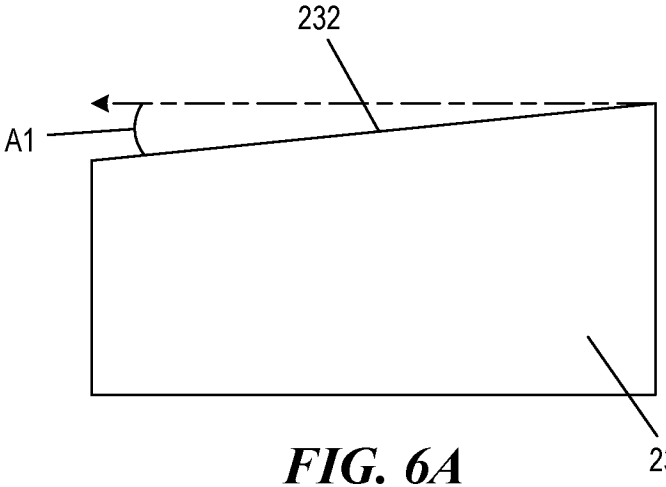
FIG. 6A is a cross-sectional view of a dressing board having a sloped working surface.
Figure 6B:
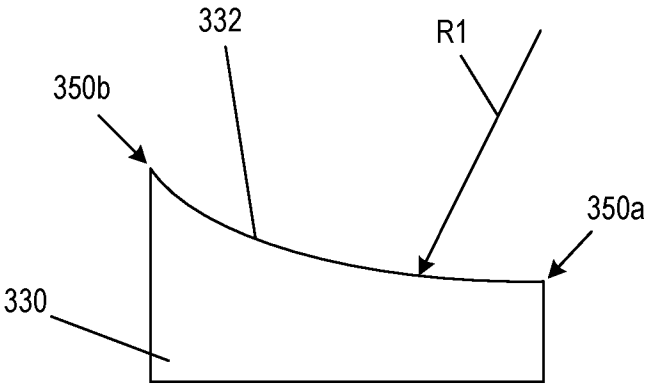
FIG. 6B is a cross-sectional view of a dressing board having a concave curved working surface.
Figure 6C:
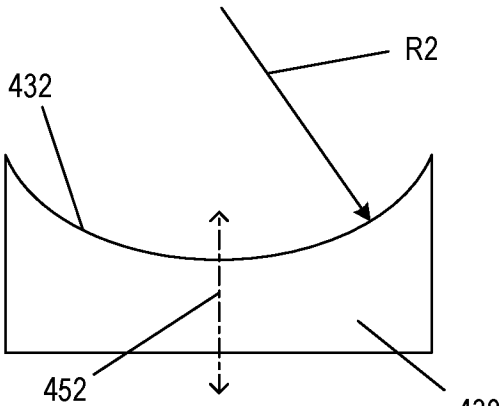
FIG. 6C is a cross-sectional view of a dressing board having a concave curved working surface.

FIGS. 6B and 6C illustrate embodiments of dressing boards having concave working surfaces. For example, the working surface 332 of the dressing board 330 in FIG. 6B has a first end 350*a* that is substantially parallel to horizontal and a second end 350*b* that is non-parallel to horizontal. The portions of the working surface 332 between the two ends 350*a*, 350*b* can be concave. For example, the working surface 332 can have a radius of curvature R1 between the first and second ends 350*a*, 350*b*. In some embodiments the radius of curvature R1 is constant between the two ends 350*a*, 350*b*. In some embodiments, the radius of curvature of the working surface 332 of the dressing board 330 varies between the two ends 350*a*, 350*b*. In some embodiments, as illustrated in FIG. 6C, the working surface 432 of a dressing board 430 can have a radius of curvature R2 and can be symmetric about a vertical (e.g., perpendicular to horizontal and/or parallel to the Earth's gravitational force) centerline 452 of the working surface 430. In yet additional embodiments, the working surface of the dressing board can be symmetric about the vertical centerline of the dressing board and have a non-uniform radius of curvature.

Figure 6D:
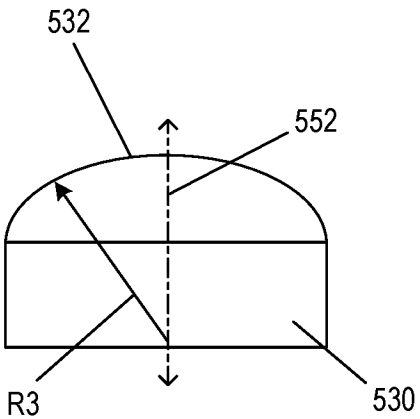
FIG. 6D is a cross-sectional view of a dressing board having a convex curved working surface.

In addition to or instead of flat, sloped, and concave working surfaces, dressing boards may include convex surface. For example, as illustrated in FIG. 6D, all or a portion of the working surface 532 of the dressing board 530 can be convex. The working surface 532 can have a radius of curvature R3 that is either uniform or non-uniform across a width of the working surface 532. As illustrated, the working surface 532 can be symmetric about a vertical centerline 552 of the working surface 530. In some embodiments, the working surface 532 is not symmetric about the vertical centerline 552 of the working surface 532.

In some embodiments, the working surface of the dressing board is sized, in a direction parallel to the axis of rotation of the blade, to span the entire cutting surface from a first lateral edge to a second lateral edge of the blade (FIG. 5B). Alternatively, the working surface of the dressing board can be sized to span only a portion of the cutting surface in a direction parallel to the axis of rotation.

Use of dressing boards having non-flat working surfaces can allow for the repair and/or refurbishment of blades that were previously disposable. Additionally, use of non-flat working surfaces can allow for the use of softer materials for the blades than has been historically acceptable. For example, in the absence of a dressing board capable of sharpening a complex cutting surface, it is advantageous (in some cases, economically necessary) to use hard and/or durable materials to form the cutting surface of the blade. Such materials include silicon carbide, stainless steel, and other hardened materials. Such materials can, in many applications be damaging to the substrate and other portions of the semiconductor devices being diced/trimmed. Use of softer, less damaging blade materials, however, requires more frequent disposal of the blades in the absence of a means to repair or refurbish the blade. Using the dressing boards disclosed herein, blades having non-flat cutting surfaces can now be refurbished and repaired, thereby allowing for use of softer, less damaging, and less durable blade materials (e.g., aluminum and/or other softer materials).

Figure 7:
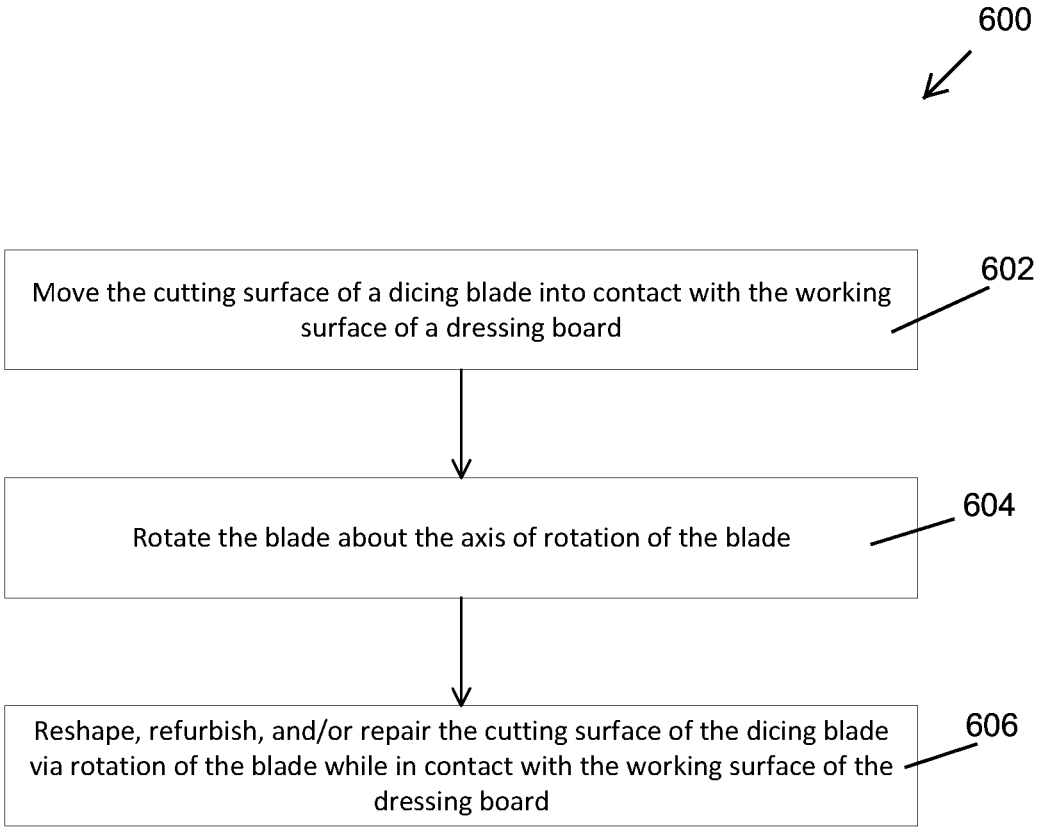
FIG. 7 is a flow chart of an embodiment of a method of sharpening a cutting surface of a blade.

FIG. 7 is a flow chart of an embodiment of a method 600 of repairing/refurbishing cutting surfaces of blades. The method 600 can include moving a cutting surface of a blade into contact with a working surface of a dressing board (block 602). In some embodiments, the blade is moved toward the dressing board in a direction perpendicular to the axis of rotation of the blade and/or parallel to the gravitational pull of the Earth. The method 600 can include rotating the blade about the axis of rotation of the blade to cause friction between the blade and the working surface (block 604). Friction between the blade and the working surface of the dressing table can reshape, refurbish, and/or repair the cutting surface of the blade to a desired shape (block 606). In some embodiments, reshaping or repairing the blade can be accomplished without orienting the axis of rotation of the blade in more than one orientation. Example working surface shapes are disclosed and described above.

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. For example, while certain geometries of dressing board working surfaces are illustrated and disclosed herein, the advantages of the inventive concepts of the present application are not limited to the illustrated embodiments. Other working surface shapes and configurations may be used to repair/refurbish blades, including working surfaces incorporating concave, flat, slanted, and/or convex portions. In some embodiments, at least 10% of the working surface can be flat and at least 10% of the working surface can be curved (e.g., concave and/or convex). Additionally, while steps are presented in a given order, alternative embodiments may perform steps in a different order. Moreover, the various embodiments described herein may also be combined to provide further embodiments. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Where the context permits, singular or plural terms may also include the plural or singular term, respectively. Additionally, the term "comprising" is used throughout to mean including at least the recited feature(s) such that any greater number of the same feature and/or additional types of other features are not precluded. Directional terms, such as "upper," "lower," "front," "back," "vertical," and "horizontal," may be used herein to express and clarify the relationship between various elements. It should be understood that such terms do not denote absolute orientation. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A method of manufacturing or maintaining a semiconductor dicing or grinding blade, the method comprising:

moving a blade into contact with a grinding surface of a dressing board, the blade comprising:

an axis of rotation;

an annular cutting surface configured to rotate about the axis of rotation; and a blade body extending between the axis of rotation and the annular cutting surface; and rotating the annular cutting surface about the axis of rotation while the blade is in contact with the grinding surface of the dressing board, wherein rotation of the annular cutting surface causes the grinding surface of the dressing board to shape the annular cutting surface to a desired shape;

wherein at least a portion of a cross-section of the desired shape, as taken on a cutting plane parallel to the axis of rotation of the blade, is concave and is not parallel to the axis of rotation of the blade.

2. The method of claim 1, wherein the cross-section of the desired shape, as taken on the cutting plane parallel to the axis of rotation of the blade, comprises a first portion and a second portion, wherein:

a tangent line to the first portion forms a first angle with respect to the axis of rotation of the blade;

a tangent line to the second portion forms a second angle with respect to the axis of rotation of the blade; and the first angle is not equal to the second angle.

3. The method of claim 2, wherein neither the first angle nor the second angle is parallel to the axis of rotation of the blade.

4. The method of claim 1, wherein the cross-section of the desired shape, as taken on the cutting plane parallel to the axis of rotation of the blade, comprises a first portion and a second portion, wherein:

a tangent line or line parallel to two points along the first portion forms a first angle with respect to the axis of rotation of the blade;

a tangent line or line parallel to two points along the second portion forms a second angle with respect to the axis of rotation of the blade; and the first angle is not equal to the second angle.

5. The method of claim 1, wherein the cross-section of the desired shape, as taken on the cutting plane parallel to the axis of rotation of the blade, comprises a straight portion extending along at least 10% of the desired shape and a curved portion extending along at least 10% of the desired shape.

6. The method of claim 1, wherein the cross-section of the desired shape, as taken on the cutting plane parallel to the axis of rotation of the blade, is curved along a majority of the desired shape.

7. The method of claim 1, wherein moving the blade into contact with the grinding surface of the dressing board comprises moving the blade in a direction that is both perpendicular to the axis of rotation of the blade and parallel to a gravitational pull of the Earth.

8. The method of claim 1, wherein moving the blade into contact with the grinding surface of the dressing board comprises moving the blade in a direction perpendicular to the axis of rotation of the blade.

9. The method of claim 1, wherein during rotation of the annular cutting surface while in contact with the grinding surface, the entire annular cutting surface is shaped by the grinding surface without reorientation of the axis of rotation of the blade with respect to the dressing board.

* * * * *